United States Patent [19]

Born et al.

[11] Patent Number: 5,045,221

[45] **Date of Patent: * Sep. 3, 1991**

[54] POLYSULPHURIZED OLEFIN COMPOSITIONS, THEIR PREPARATION AND THEIR USE AS ADDITIVES FOR LUBRICANTS

[75] Inventors: Maurice Born, Nanterre; Lucienne Briquet, Rueil-Malmaison; Jacques Lallement, Aubervilliers; Guy Parc, Rueil-Malmaison, all of France

[73] Assignee: Istitut Francais Du Petrole, Rueil-Malmaison, France

[ * ] Notice: The portion of the term of this patent subsequent to Jun. 13, 2006 has been disclaimed.

[21] Appl. No.: 403,968

[22] Filed: Sep. 7, 1989

[30] Foreign Application Priority Data

Sep. 7, 1988 [FR] France ..... 88 11773

[51] Int. Cl.[5] ..... C10M 135/02; C10M 135/20

[52] U.S. Cl. ..... 252/45; 568/26

[58] Field of Search ..... 252/45, 48.8; 568/26

[56] References Cited

U.S. PATENT DOCUMENTS

| | | | |
|---|---|---|---|
| 31,522 | 2/1984 | Rieder | 252/34 |
| 3,471,404 | 10/1969 | Myers | 252/45 |
| 3,697,499 | 10/1972 | Myers | 252/48.8 |
| 4,147,640 | 4/1979 | Jayne et al. | 252/45 |
| 4,172,027 | 10/1979 | Ham et al. | 208/140 |
| 4,188,297 | 2/1980 | Jayne et al. | 252/45 |
| 4,204,969 | 5/1980 | Papay et al. | 252/45 |
| 4,225,488 | 9/1980 | Horodysky et al. | 252/45 |
| 4,530,917 | 7/1985 | Berrebi | 502/220 |
| 4,563,302 | 1/1986 | Griffin et al. | 252/45 |
| 4,578,202 | 3/1986 | Urban et al. | 252/33.4 |
| 4,631,139 | 12/1986 | Burton et al. | 252/49.3 |
| 4,645,610 | 2/1987 | Born et al. | 252/45 |
| 4,795,576 | 1/1989 | Born et al. | 252/45 |
| 4,839,069 | 6/1989 | Born et al. | 252/45 |

FOREIGN PATENT DOCUMENTS

| | | |
|---|---|---|
| 159936 | 6/1987 | European Pat. Off. . |
| 2605328 | 4/1988 | France . |
| 2615861 | 12/1988 | France . |

OTHER PUBLICATIONS

G. D. Hobson, ed. Modern Petroleum Technology, 4th ed., pp. 754–755.

*Primary Examiner*—Prince E. Willis
*Assistant Examiner*—Jerry D. Johnson
*Attorney, Agent, or Firm*—Millen, White & Zelano

[57] ABSTRACT

Polysulphurized olefin compositions used as additives for gear oils, cutting oils, and as sulphurizing agents in organic media are obtained by a process comprising:

a stage (1) in which at least one compound chosen from among sulphur dichloride and monochloride is reacted with at least one aliphatic monpolefin with 2 to 12 carbon atoms, thus forming an adduct;

a stage (2) in which sulphurized hydrogen and at least one mercaptan is reacted with ammonium or alkali metal hydroxide dissolved in at least one aliphatic monoalcohol with 1 to 4 carbon atoms, which is substantially anhydrous, so as to give an alcoholic solution;

a stage (3) in which contacting takes place between the adduct obtained in stage (1) and the alcoholic solution obtained in stage (2);

a stage (4), in which the resulting mixture is heated and then the aliphatic monoalcohol is eliminated by distillation, while adding water in a quantity adequate for maintaining in solution the reagents and the mineral products formed during the reaction; and a stage (5) in which elimination takes place of the aqueous phase and recovery takes place of the organic phase mainly constituted by the polysulphurized olefin composition.

14 Claims, No Drawings

POLYSULPHURIZED OLEFIN COMPOSITIONS, THEIR PREPARATION AND THEIR USE AS ADDITIVES FOR LUBRICANTS

The invention relates to sulphurized organic additives particularly used for improving the extreme pressure properties of lubricants. It more particularly relates to novel products of the polysulphurized olefin type with a high sulphur content and a very low chlorine content, their preparation and their use as additives for synthetic or mineral lubricants.

In earlier-dated French patent applications, the Applicant has described polysulphurized olefin compositions obtained by processes including the following stages.

In stage (1) at least one compound chosen from among sulphur monochloride and dichloride is reacted with at least one aliphatic monoolefin with 2 to 12 carbon atoms, so as to form an addition product.

In a following stage (2) reaction takes place between said addition product and either an alkali metal or alkaline earth polysulphide or sulphide, or with at least one mercaptate or mercaptate-polysulphide in accordance with the general formula $RS_xM$, in which R represents an aliphatic radical, an aliphatic radical carrying at least one functional group, an aromatic radical, an aromatic radical substituted by at least one aliphatic radical, or a heterocyclic radical; M represents an atom or a monovalent group corresponding to a mineral base of formula MOH; and x assumes a mean value of at least 1.

Optionally there is a stage (3), in which the product of stage (2) is contacted with an aqueous mineral base solution.

In addition, U.S. Pat. No. 4,563,302 and European patent application 28489 describe a relatively similar process for preparing polysulphurized olefins usable as extreme pressure additives for lubricating oils. This process comprises the following main stages. A stage (1), in which sulphur monochloride is reacted at about 30° to 100° C. with an aliphatic monoolefin with $C_3$ to $C_6$ (generally isobutene), preferably in the presence of a promoter consisting of a lower alcohol, so as to form an adduct; A stage (2), in which reaction takes place between said adduct and sulphur, sodium sulphide, an alkyl mercaptan with 1 to 12 carbon atoms and 0 to 0.5 g of NaSH per mole of sulphur halide in a hydroalcoholic medium at a temperature of 50° C. to reflux in order to form a sulphurized olefin; A stage (3) in which said polysulphurized olefin contained in the hydroalcoholic medium is recovered.

It is stated in said patent that the sulphur content of the products obtained can reach 48.8% by weight, but analysis indicates that such products still contain a residual chlorine content of about 0.25% by weight.

Consideration of the prior art reveals that, in particular, isobutylene polysulphides prepared in reaction media containing large water proportions still contain residual chlorine quantities exceeding 0.1% by weight complicating, the complete elimination of the chlorine as a result of the insolubility of the adduct in the reaction medium, so that there is an incomplete heterogeneous phase reaction.

In most of the processes described, the water is generally introduced into the reaction medium, in the presence of a minor quantity of an alcohol (particularly isopopanol), in order to dissolve the alkaline sulphide used and which itself usually contains a significant quantity of water of hydration (at least 40% by weight in the case of industrial $Na_2S$).

However, it is possible to increase the solvent nature of the reaction medium with respect to the adduct by substituting the dissolving water of the hydrated alkaline sulphide with a lower alcohol, but the alcohol quantities then required are incompatible with economically satisfactory industrial production.

It is also known that toxicological and ecological constraints are leading to new legislation in connection with additives for lubricants, so that in the near future, in all probability a maximum chlorine content will be imposed which will be well below 0.1% by weight for said products.

It has now been found that it is economically possible to use a reaction medium in which the adduct is soluble, which leads to an increased reactivity with respect to the alkaline polysulphide. This novel reaction medium does not lead to reaction volumes exceeding those required by the prior art and leads to (poly)sulphurized olefin compositions with very high sulphur content and very low residual chlorine contents. Therefore, they can be advantageously used as additives for lubricants and significantly improve the extreme pressure properties thereof. An important advantage of the invention is that the viscosity and solubility in the lubricants of the polysulphurized olefin compositions in question can be regulated as a function of the relative proportions of the reagents used.

In general terms, the polysulphurized olefin compositions according to the invention can be defined as consisting of products obtained by a process comprising the following stages:

A stage (1), in which at least one compound chosen from among sulphur dichloride or monochloride is reacted, e.g., at a temperature of 20° to 80° C., with at least one aliphatic monoolefin having 2 to 12 carbon atoms, thus forming an addition product (or adduct);

A stage (2), in which the hydrogen sulphide and at least one mercaptan is reacted with an alkali metal hydroxide (sodium, potassium) or ammonium hydroxide dissolved in at least one substantially anhydrous aliphatic monoalcohol with $C_1$ to $C_4$. Optionally, elemental sulphur is added as a function of the proportions of the sulphide, hydrogen sulphide, mercaptate, polysulphide and/or mercaptate polysulphide of alkali metals which it is wished to obtain in the mixture;

A stage (3), in which contacting takes place between said adduct and optionally at least one saturated or unsaturated monohalogenated hydrocarbon compound, as defined hereinafter, with the alcoholic solution obtained following stage (2), kept at a predetermined temperature, e.g., 20° to 120° C., during while optionally operating under pressure;

A stage (4), in heating is heated the resultant mixture is heated for a predetermined time at a temperature, e.g., ranging from 50° to 120° C. (while operating under pressure), followed by the elimination of the monoalcohol by distillation, while adding a water volume sufficient to maintain in solution the reagents and the mineral products formed during the reaction;

A stage (5), in which, after settling, the aqueous phase is eliminated and the polysulphurized olefin constituting the organic phase is recovered.

Optionally, a stage (6) in which contacting takes place between the product obtained and a basic compound, such as a mineral base, and it is washed with water.

In stage (1) of the process for the preparation of compounds according to the invention, the starting olefins can contain 2 to 12 carbon atoms and can be used either alone or in mixed form. Most frequently, isobutylene, hexenes, di- and tri-isobutylenes, tri- and tetra-propylenes or mixtures thereof are normally used.

The olefin or olefin mixture can be used in a proportion of 1.5 to 2.5 and preferably 1.8 to 2.2 moles per mole of sulphur monochloride and/or dichloride. It is generally introduced into the liquid sulphur monochloride and/or dichloride at a temperature of 20° to 80° C. and more specifically 30° to 50° C.

The sulphurized mixture prepared in stage (2) from hydrogen sulphide and mercaptan can have the proportions of a sulphide, hydrogen sulphide, polysulphide or mercaptate polysulphide of alkali metal (e.g., sodium or potassium) or ammonium, or a mixture thereof.

The mixture is usually in the form of sodium compounds. Generally, 0.01 to 1 mole of hydrogen sulphide and preferably 0.05 to 0.95 mole thereof per mole of hydroxide and 0.01 to 1 mole of mercaptan and preferably 0.05 to 0.95 thereof per mole of hydroxide are used.

The elemental sulphur optionally used in stage (2), together with the sulphurized compound, can be used in a molar ratio to the hydroxide introduced between 0 and approximately 3.6/1 and more particularly 0 to 2.5/1.

In stage (2), the sulphurized compound is formed and the elemental sulphur is optionally introduced into a light aliphatic monoalcohol containing 1 to 4 carbon atoms.

Examples of light aliphatic monoalcohols are methanol, ethanol, n-propanol, isopropanol, n-butanol, isobutanol and tert.-butanol, methanol being preferred. The quantity used is advantageously 100 to 400 cc, preferably 125 to 200 cc per mole of hydroxide used. The term "substantially anhydrous " monoalcohol is understood to mean a monoalcohol containing no more than 5% by weight of water and preferably less than 1% by weight of water.

In stage (3) of the process, the monohalogenated saturated and/or unsaturated hydrocarbon compound or compounds optionally used together with the adduct obtained from stage (1) can consist of straight or branched chlorides, bromides or iodides of alkyls or alkenyls with $C_1$ to $C_{12}$ (preferably $C_2$ to $C_4$), optionally substituted cycloalkyls and/or cycloalkenyls with $C_5$ to $C_{12}$ (preferably $C_6$), or optionally substituted arylalkyls and/or arylalkenyls with $C_6$ to $C_{12}$ (preferably $C_8$ and $C_9$).

Examples are in particular chlorides, bromides and iodides of methyl, ethyl, isopropyl, n-propyl, tert.-butyl, isobutyl, n-butyl, tert.-amyl, isoamyl, n-amyl, n-hexyl, 2-ethylhexyl, n-octyl, cyclohexyl, benzyl and mixtures thereof. Reference can also be made to 1-chloroethylene, 1-chloropropene, 2-chloropropene, 3-chloropropene, 1-chloro-1-butene, 1-chloro-2-butene, 2-chloro-2-butene, 3-chloro-1-butene, 1-chloro-2-methylpropene, 3-chloro-2-methylpropene or 3-chloro-1-phenyl-1-propene and 2-chlorothiophene, as well as the corresponding brominated and iodized derivatives. Advantageously use is made of methyl chloride, n-butyl chloride and methallyl chloride.

Within the scope of the invention, it is possible to at least partly replace the monohalogenated hydrocarbon compound as defined hereinbefore by at least one monohalogenated hydrocarbon compound also carrying at least one frictional group having one or more heteroatoms (such as oxygen and/or nitrogen and/or sulphur). Among these functional monohalogenated hydrocarbons, use is mainly made of monochlorinated or monobrominated compounds and these are advantageously chosen from among:

monohalogenated compounds containing at least one alcohol function and in particular:aliphatic, alicyclic or aromatic-aliphatic monoalcohols, e.g., containing 2 to 18 carbon atoms, such as, e.g., 2-chloro and 2-bromo-ethanols, chloro- and bromo-propanols, butanols, pentanols, hexanols, heptanols, octanols, nonanols, decanols, undecanols and dodecanols, as well as chloro- or bromo-benzyl alcohols and chloro- or bromo-phenyl ethyl alcohols; halides of polyols, such as e.g. 3-chloro or 3-bromo-1,2-propane diol (and the corresponding epoxy derivatives, e.g. 1-chloro or 1-bromo,2,3-epoxypropane); halides of (poly)oxyalkylenated monoalcohols, such as, e.g., chloro- and bromo-(poly)-ethoxyethanols, (poly)-ethoxypropanols, (poly)-propoxyethanols and (poly)-propoxy propanols;

monohalogenated compounds containing at least one phenol function, such as, e.g., chlorophenols and bromophenols either unsubstituted or substituted e.g. by alkyl groups;

monohalogenated compounds containing at least one carboxylic function, such as e.g. chloroacetic, bromoacetic, propionic, butyric, valeric, benzoic and succinic acids;

monohalogenated compounds containing at least one amine function, particularly aliphatic, alicyclic or aromatic aliphatic compounds, such as, e.g., chloroethylamine hydrochloride and hydrochlorides of N,N-chlorodimethyl, diethyl and dipropyl-ethylamines, chloro- and bromo-benzylamines and chloro- and bromo-phenylethylamines;

monohalogenated compounds containing at least one amide function, such as, e.g., chloro- and bromo-acetamides and propionamides; or monohalogenated compounds containing at least one thiol function, such as, e.g., chloro- and bromo-mercaptobenzothiazoles, chloro- and bromo-phenylmercaptans and chloro- and bromo-benzylmercaptans.

Among is made among the functional monohalogenated compounds having several different types of groups, reference can be made to compounds with hydroxyl and carboxylic acid functions, such as, e.g., 5-chlorosalicylic acid or 3-chloro-4-hydroxymandelic acid; compounds with amine and carboxylic acid functions, such as, e.g., 4-chlorophenylalanine or compounds with amine and hydroxyl functions.

Without passing beyond the scope of the invention, it is possible to use functional monohalogenated hydrocarbon compounds together with non-functional monohalogenated hydrocarbon compounds as defined above and in all proportions.

The optionally used monohalogenated hydrocarbon compound proportion is generally 1 to 70% in gram atoms of halogen compared with the total number of gram atoms of halogen of the adduct+monohalogenated hydrocarbon compound whole. This proportion generally corresponds to approximately 0.015 to 1.9 monohalogenated hydrocarbon compound moles to 100 g of adduct and in particular when the starting monoolefin is isobutylene.

The proportion of adduct and monohalogenated hydrocarbon compound optionally used compared with the hydroxide employed generally corresponds to 1/1 to 0.5/1 and preferably 0.80/1 to 0.75/1 of halogen atoms per mole of hydroxide.

Stage (3) can be performed under a low pressure, whereby the relative pressure can, e.g., be up to 1 MPa (10 bar).

The additives according to the invention can also be prepared by means of a continuous process with parallel streams and multiple contacts. In this case, the reaction of stage (3) is generally performed under pressure.

The polysulphurized olefin compositions according to the invention can have a sulphur content up to approximately 65% by weight for particularly low residual chlorine contents and generally below approximately 0.1% by weight, usually below 0.05% by weight and sometimes even below approximately 0.01% by weight, especially methanol and/or a slight reaction pressure is used.

The products according to the invention, the corrosiveness of which with respect to copper (ASTM D 130 - NF M 07-015 3 h, 121° C.) is equal to or below 3, when as they are incorporated at a dose such as the sulphur content of the oil is equal to 2% by weight, can be used for the formulation of gear oils and for the formulation of cutting oils for cuprous metals with doses between 0.1 and 20% by weight. The products according to the invention, whose corrosiveness of which with respect to copper under the conditions indicated above exceeds 3, can be used for the formulation of cutting oils for ferrous metals at doses between 0.1 and 20% by weight and as sulphurizing agents in an organic medium.

The following examples illustrate the invention without limiting it. Examples 1 to 4 are given for comparison purposes. In these examples RSH represents the mercaptan used and $I_A$ and $I_{OH}$, when they are mentioned, respectively represent the acid and hydroxyl number.

EXAMPLE 1 (Comparative)

A sulphurized adduct of isobutylene is prepared according to EP-A-228 489 reacting at 50° to 65° C. 1350 g of $S_2Cl_2$ (10 moles) and 1265 g of isobutylene (21.8 moles). This gives 2500 g of addition product. The experiment is continued as in the example of the aforementioned European patent application.

Into a second reactor are introduced 188.4 g of an alcoholic solution (64.7% by weight isopropanol, 13.8% tert.-butanol and 20.3% water), 23.3 g of water, 246.0 g of an aqueous 29.09% by weight solution of NaHS (1.27 mole), 78.0 g of an aqueous 50% by weight soda solution (0.98 mole) and 6.1 g of flowers of sulphur (0.44 gram atom). In this test, the weights of liquid water and alcohols introduced are respectively equal to 275 g and 147.9 g, i.e. in all approximately 423 g of hydroalcoholic mixture.

The mixture is stirred and heated at 75° C., followed by the simultaneous dropwise introduction over 2 hours into the medium of 270.0 g of adduct and 33.9 g of tert.-butyl mercaptan (0.36 mole). The mixture is then refluxed for 3 hours. The alcoholic solvent is then distilled to 90° C. Heating is then stopped and distillation is continued under reduced pressure to 65° C. The organic phase is washed with water, evaporated under reduced pressure between 100° and 110° C. and then filtered.

This gives a clear oil, whose elementary analysis is as follows:

S=46.5% by weight

Cl=0.63% by weight (6300 ppm).

EXAMPLE 2 (Comparative)

The same experiment is repeated using 94 g of NaHS, $H_2O$ in powder form (1.27 mole containing 22.9 g of water) and whilst substituting the mixture of water and alcohols of example 1 by the same volume of substantially anhydrous methanol, namely 400.1 g (423 g-22.9 g).

The experiment is continued in accordance with the aforementioned operating procedure and gives a clear oil with the following elementary analysis:

S=47.7% by weight

Cl=0.21% by weight (2100 ppm).

EXAMPLE 3 (Comparative)

The experiment of example 1 is repeated using 10 molar % more of NaHS (270.6 g of 29.09% solution), NaOH (85.8 g of 50% aqueous solution) and tert.-butyl mercaptan (37.3 g). Following the reaction, a product is obtained with the following analytical characteristics:

S=45.6% by weight

Cl=0.35% by weight (3500 ppm).

EXAMPLE 4 (Comparative)

The experiment of example 2 is repeated using 10 molar % more of NaHS and tert.butyl mercaptan, the reaction being performed in anhydrous methanol. After the reaction a product is collected having the following analytical characteristics:

S=45.4% by weight

Cl=0.05% by weight (500 ppm).

It is found that the use of a substantially anhydrous alcohol instead of a hydroalcoholic mixture makes it possible to very significantly reduce the residual chlorine content of the sulphurized additives obtained.

EXAMPLE 5

A sulphurized adduct is prepared by reacting a mixture constituted by 90 molar % of isobutylene (1210 g=21.6 mole) and 10 molar % of diisobutylene (268.5 g =2.4 mole) with 1620 g of $S_2Cl_2$ (12 mole) at 50° C. The thus obtained adduct contained 26.7% by weight of chlorine.

In a second reactor is prepared a solution constituted by 150 $cm^3$ of substantially anhydrous methanol and 36 g of NaOH in pellet form (0.9 mole).

After dissolving, into the alcoholic medium are introduced 2.38 g of gaseous $H_2S$ (0.07 mole), 68.4 g of tert.-butyl mercaptan (0.76 mole) and then 10.65 g of flowers of sulphur (0.33 gram atom). The thus obtained mixture is heated for 0.5 hours at 75° C. in order to ensure the formation of the mixture of alkaline tert.-butyl polysulphide and polysulphide.

Into the alkaline alcoholic medium are then introduced dropwise in 2 hours 100 g of isobutylene/diisobutylene adduct. In this test, the quantity of alkaline reagents used represents a molar excess of 16.5% compared with the chlorine quantity used and the molar ratio $(H_2S+RSH)/S$ is equal to 2.5. The mixture is boiled for 7 hours and then the methanol distilled whilst introducing 150 $cm^3$ of water into the medium. The mixture is allowed to settle, the organic phase recovered and reflux treated for 3 hours with 130 $cm^3$ of an aqueous 10% soda solution. It is washed twice with 100 $cm^3$ of water, dried under a reduced pressure at 100° C. and then filtered. The physicochemical characteristics of the thus obtained product are given in table 1.

EXAMPLE 6

The experiment of example 5 is repeated, but reversing the relative molar proportions between $H_2S$ and tert.-butyl mercaptan, namely 14.65 g of $H_2S$ (0.43 mole) and 3.9 g of tert.-butyl mercaptan (0.034 mole) and 6 g of flowers of sulphur (0.19 gram atom). Following reaction and treatment, a product is obtained whose characteristics are given in table 1.

EXAMPLE 7

The experiment of example 5 is repeated using 88.7 g of flowers of sulphur (2.77 gram atom). In this test the molar ratio $(H_2S+RSH)/S$ is equal to 0.3. After reaction and without 10% soda treatment, an orange oil is recovered, whose characteristics are given in table 1.

EXAMPLE 8

The experiment of example 5 is repeated, reacting under relative molar proportions 0.666/0.333 the tert.-butyl mercaptan (40.5 g, 0.45 mole) and $H_2S$ (7.7 g, 0.226 mole) and using 11.4 g of flowers of sulphur (0.356 gram atom). In this test the molar ratio $(H_2S+RSH)/S$ is equal to 1.9.

EXAMPLE 9

The experiment of example 8 is repeated whilst substituting the tert.-butyl mercaptan by the same molar quantity of methyl mercaptan (21.6 g).

EXAMPLE 10

The experiment of example 9 is repeated, substituting the methyl mercaptan by the same molar quantity of tert.-dodecyl mercaptan (90.9 g).

EXAMPLE 11

The experiment of example 7 is repeated using 135 g of an adduct resulting from the reaction of an olefin mixture constituted by 33.3 molar % of isobutylene, 33.3% diisobutylene and 33.3% of nonenes (tripropylene) with $S_2Cl_2$ in proportions of 2 mole of olefin per mole of $S_2Cl_2$. The adduct obtained contains 19.9% by weight of chlorine. After reaction and without soda treatment, an additive is obtained, whose characteristics are given in table 1.

EXAMPLE 12

The experiment of example 6 is repeated using a mixture constituted by 90 g of isobutylene-diisobutylene adduct and 7 g of n-butyl chloride (0.0757 mole). The chlorine proportion from the n-butyl chloride compared with the total chlorine is 10 atomic %. After reaction and treatment, an additive is collected, whose characteristics are given in table 1.

EXAMPLE 13

The experiment of example 12 is repeated substituting the n-butyl chloride by the same molar quantity of methallyl chloride (6.93 g). After reaction and treatment, an additive is collected, whose characteristics are given in table 1.

EXAMPLE 14

The experiment of example 12 is repeated, the alcoholic solution of polysulphide and alkaline mercaptate polysulphide being introduced into the halogenated mixture. After reaction and treatment, an additive is collected, whose characteristics are given in table 1.

EXAMPLE 15

The experiment of example 8 is repeated using a halogenated mixture constituted by 64.4 g of isobutylene-diisobutylene adduct, 25.4 g of 1-chloro-2-propanol (0.269 mole) and using 11.7 g of flowers of sulphur (0.365 gram atom). In this test the molar ratio $(H_2S+RSH)/S$ is equal to 1.85. After reaction and without subsequent soda treatment and after washing with water to eliminate the excess alkaline polysulphides and polythiodipropylene glycol formed, an additive is collected with the following physicochemical characteristics:

S=41.2% by weight
Cl=0.044% by weight (440 ppm)
$I_{OH}=96$
Kinematic viscosity at 100° C.=4.94 $mm^2/s$.

EXAMPLE 16

The experiment of example 15 is repeated using a halogenated mixture constituted by 64.4 g of isobutylene-diisobutylene adduct and 25.2 g of 1-chloro-2,3-epoxy propane (0.269 mole). In this example the molar ratio $(H_2S+RSH)/S$ is equal to 1.85. After reaction, washing, drying and filtration, the additive obtained has the following characteristics:

S=40.9% by weight
Cl=0.012% by weight (120 ppm)
$I_{OH}=84$
Kinematic viscosity at 100° C.=15.2 $mm^2/s$.

EXAMPLE 17

A solution is prepared, which is constituted by 300 $cm^3$ of anhydrous methanol, 34 g of soda in pellet form (0.85 mole), 38.34 g of tert.-butyl mercaptan (0.426 mole), 6.83 g of $H_2S$ (0.213 mole) and 11.7 g of flowers of sulphur (0.365 gram atom). In this example the molar ratio $(H_2S+RSH)/S$ is equal to 1.75. Into the thus obtained alkaline mixture is introduced a halogenated mixture constituted by 64.4 g of isobutylene-diisobutylene adduct and 25.42 g of monochloroacetic acetic acid (0.269 mole), the addition taking place in 2 hours. The mixture is refluxed for 7 hours and the methanol distilled, whilst introducing 150 $cm^3$ of water. 150 $cm^3$ of cyclohexane are introduced for extracting the organic phase. Cooling takes place and the organic phase is recovered and treated under vigorous stirring by 120 $cm^3$ of an aqueous 6N HCl solution for 2 hours at 70° C. Settling takes place, the recovered organic phase is washed ice with 150 $cm^3$ of water and is then evaporated and dried under reduced pressure at 100° C. The carboxylic sulphurized compound obtained has the following characteristics:

S=41.2% by weight
Cl=0.032% by weight (320 ppm)
Kinematic viscosity at 100° C.=21.2 $mm^2/s$
$I_A=39$

EXAMPLE 18

The experiment of example 8 is repeated using a halogenated mixture constituted by64.4 g of isobutylene-diisobutylene adduct and 19.14 g of 4-chloromethyl-2,6-di-tert.-butyl-phenol (0.075 mole). In this example the molar ratio $(H_2S+RSH)/S$ is equal to 1.9. After treating with soda, washing, drying under reduced pressure at 100°.C. and filtration, an additive is collected whose infrared spectrum reveals the presence of unbonded phenol groups. It has the following characteristics:

S=35.7% by weight
Cl=0.031% by weight (310 ppm)
Kinematic viscosity at 100° C.=11.7 $mm^2/s$
$I_{OH}$=29.

TABLE 1

| Additive of example | Molar ratios of reagents used: Cl/NaOH | S/NaOH | $\frac{H_2S + RSH}{S}$ | Molar proportion (%): $H_2S$ | HSR | Viscosity of additive at 100° C. $mm^2/s$ | S (wt %) | Cl* ppm | 10% by weight solubility in: SAE 90 PAO | 100 N solvent |
|---|---|---|---|---|---|---|---|---|---|---|
| 5 | 0.836 | 0.367 | 2.5 | 8.4 | 91.6 | 2.5 | 45.0 | 91 | soluble | soluble |
| 6 | 0.836 | 0.21 | 2.5 | 91.6 | 8.4 | 13.3 | 46.5 | 194 | insoluble | soluble |
| 7 | 0.836 | 3.08 | 0.3 | 8.4 | 91.6 | 12.8 | 60.1 | 117 | insoluble | soluble |
| 8 | 0.836 | 0.39 | 1.9 | 33.3 | 66.6 | 4.4 | 45.7 | 132 | soluble | soluble |
| 9 | 0.836 | 0.39 | 1.9 | 33.3 | 66.6 | 7.4 | 46.4 | 200 | — | soluble |
| 10 | 0.836 | 0.39 | 1.9 | 33.3 | 66.6 | 2.4 | 36.4 | 112 | soluble | soluble |
| 11 | 0.836 | 3.08 | 0.3 | 8.4 | 91.6 | 6.4 | 46.7 | 134 | soluble | soluble |
| 12 | 0.836 | 0.21 | 2.5 | 91.6 | 8.4 | 10.6 | 46.1 | 147 | — | soluble |
| 13 | 0.836 | 0.21 | 2.5 | 91.6 | 8.4 | 10.5 | 46.2 | 132 | — | soluble |
| 14 | 0.836 | 0.21 | 2.5 | 91.6 | 8.4 | 14.2 | 46.5 | 152 | — | soluble |

*X-fluorescence dosing

MEASUREMENT OF THE CORROSIVE ACTIVITY OF THE PRODUCTS ACCORDING TO THE INVENTION

Corrosion tests using a copper blade are performed in accordance with ASTM D standard 130 (NF M 07-015) using a mineral oil SAE 90 containing 2% by weight of sulphur as the additive.

The results obtained appear in table 2 and are expressed by a rating between 1 and 4, the number being followed by a letter defining the copper blade corrosion level.

For the formulation of car gear oils and cuprous metal cutting oils, preference is given to the use of additives leading to a rating equal to or below 3 (in particular at 121° C.). For the formulation of oils for working ferrous metals, it is possible to use products prepared according to the invention and preferably those leading to corrosion ratings above 3.

TABLE 2

| Additive of example | S in additive (wt. %) | 3 hours at 100° C. | 121° C. |
|---|---|---|---|
| 5 | 45.0 | 1 a | 1 b |
| 6 | 46.5 | 1 a | 1 b |
| 7 | 60.1 | 4 c | — |
| 8 | 45.7 | 2 a | 2 b |
| 9 | 46.4 | 2 a | 1 b |
| 10 | 36.4 | 2 a | 1 b |
| 11 | 46.7 | 4 c | — |
| 12 | 46.1 | 1 a | 2 a |
| 13 | 46.2 | 2 a | 2 b |
| 14 | 46.5 | 1 a | 2 a |

EVALUATION OF THE EXTREME PRESSURE PROPERTIES OF THE ADDITIVES ACCORDING TO THE INVENTION

Tests are performed to reveal the extreme pressure properties of the additives according to the invention, on the one hand in gear oil formulations and on the other in metal working oil formulations.

a) The additives of examples 5, 6, 8, 9, 10, 12, 13 and 14 were investigated with the aid of a machine with 4 balls in accordance with the procedures of ASTM D 2783 and 2266, with concentrations such that the sulphur content in the SAE 90 oil is 0.7% by weight. The results obtained appear in table 3.

It can be seen that the additives according to the invention, which are characterized by low corrosiveness with respect to copper can be used for the formulation of gear oils and cuprous metal cutting oils, bearing in mind their high extreme pressure characteristics.

b) Tests were performed revealing the extreme pressure properties of the additives prepared according to examples 7 and 11 in a metal cutting oil formulation using a 4 ball machine according to the procedure of ASTM D 2783.

The lubricant formulation in question was constituted by a 100 neutral solvent oil containing 3% by weight of chlorine in the form of chlorinated wax and 1% by weight of sulphur in the form of a sulphurized additive. The results obtained appear in table 4. The results show that the additives according to the invention having a high corrosiveness with respect to copper lead to very high extreme pressure performances and can be used for the formulation of ferrous metal working oils.

TABLE 3

| Additive of example | load-wear index (Kgf) | (N) | Welding load (Kgf) | (N) | diam. of impression of balls 1 h under 40 kgf (392.4 N) |
|---|---|---|---|---|---|
| None | 22.2 | 217.8 | 160 | 1569.6 | 0.80 |
| 5 | 61.1 | 599.4 | 400 | 3924.0 | 0.65 |
| 6 | 60.1 | 589.6 | 400 | 3924.0 | 0.66 |
| 8 | 62.0 | 608.2 | 400 | 3924.0 | 0.64 |
| 9 | 59.1 | 579.8 | 400 | 3924.0 | 0.61 |
| 10 | 60.4 | 592.5 | 400 | 3924.0 | 0.63 |
| 12 | 61.0 | 598.4 | 400 | 3924.0 | 0.65 |
| 13 | 64.1 | 628.8 | 400 | 3924.0 | 0.59 |
| 14 | 62.2 | 610.2 | 400 | 3924.0 | 0.67 |

TABLE 4

| Chlorinated wax (wt. %) | Additive of example | S wt. % of sulphurized additive | wt. % of additive in oil | E.P. 4 ball tests: Load-wear index (kgf) | (N) | Load before seizing (Kgf) | (N) | Welding load (Kgf) | (N) |
|---|---|---|---|---|---|---|---|---|---|
| None | None | — | — | 21.4 | 209.9 | 50 | 490.5 | 116 | 1138.0 |
| 4.62 | None | — | — | 38.1 | 373.8 | 80 | 784.8 | 200 | 1962.0 |
| None | 7 | 60.1 | 1.66 | 48.2 | 472.8 | 80 | 784 | 315 | 3090.1 |
| 4.62 | 7 | 60.1 | 1.66 | 92.2 | 904.5 | 100 | 981 | 620 | 6082.2 |
| None | 11 | 46.7 | 2.14 | 45.4 | 445.4 | 80 | 784 | 315 | 3090.1 |

TABLE 4-continued

| Chlorinated wax (wt. %) | Additive of example | S wt. % of sulphurized additive | wt. % of additive in oil | E.P. 4 ball tests: Load-wear index (kgf) | Load-wear index (N) | Load before seizing (Kgf) | Load before seizing (N) | Welding load (Kgf) | Welding load (N) |
|---|---|---|---|---|---|---|---|---|---|
| 4.62 | 11 | 46.7 | 2.14 | 91.1 | 893.7 | 100 | 981 | 620 | 6082.2 |

We claim:

1. A process for the preparation of a polysulphurized olefin composition comprising:

a stage (1) in which at least one compound selected from the group consisting of sulphur dichloride and monochloride is reacted with at least one aliphatic monoolefin with 2 to 12 carbon atoms, thus forming an adduct containing chlorine;

a stage (2) in which sulphurized hydrogen and at least one mercaptan is reacted with ammonium or alkali metal hydroxide dissolved in at least one aliphatic monoalcohol with 1 to 4 carbon atoms, which is substantially anhydrous, so as to give an alcoholic solution;

a stage (3) in which contacting takes place between the adduct obtained in stage (1) and the alcoholic solution obtained in stage (2);

a stage (4), in which the resulting mixture is heated and then the aliphatic monoalcohol is eliminated by distillation, while adding a water quantity adequate for maintaining in solution the mineral products formed during the reaction; and a stage (5) in which the aqueous phase is eliminated and the organic phase containing the polysulphurized olefin composition is recovered.

2. A process according to claim 1, wherein in stage (1), 1.5 to 2.2 mole of aliphatic monoolefin per mole of sulphur monochloride and/or dichloride is reacted.

3. A process according to claim 1, wherein in stage (1), at least one aliphatic monoolefin chosen from among isobutylene, hexene, di- and tri-isobutylenes and tri- and tetra-propylenes is reacted.

4. A process according to claim 2, wherein in stage (2), 0.01 to 1 mole of hydrogen sulphide and 0.01 to 1 mole of mercaptan per mole of hydroxide is reacted.

5. A process according to claim 4, wherein in stage (2), 100 to 400 $cm^3$ of aliphatic monoalcohol per mole of hydroxide is introduced.

6. A process according to claim 1, wherein in stage (2), elemental sulphur is added.

7. A process according to claim 6, wherein the elemental sulphur is added in a molar proportion up to 3.6/1 with respect to the hydroxide present.

8. A process according to claim 1, wherein in stage (3), the adduct is added in a proportion corresponding to a number of chlorine atoms per mole of hydroxide of 1/1 to 0.5/1.

9. A process according to claim 1, wherein in stage (3), at least one saturated or unsaturated monohalogenated hydrocarbon compound is added. said halogen being (1) at least one chloride, bromide or iodide of a straight or branched $C_{1-12}$-alkyl $C_{2-12}$-alkenyl, $C_{5-12}$-cycloalkyl, $C_{5-12}$-cycloalkenyl $C_{6-12}$-arylalkyl or $C_{6-12}$-arylalkenyl moiety; or (2) a monohalogenated compound having at least one alcohol, phenol, carboxylic, amine, amide, or thiol group.

10. A process according to claim 9, wherein the monohalogenated hydrocarbon compound is methyl chloride, n-butyl chloride or methallyl chloride.

11. A process according to claim 9, wherein the proportion of said monohalogenated hydrocarbon compound is not more than 70%, expressed as gram atoms of halogen to the total number of gram atoms of halogen contained in the adduct +monohalogenated hydrocarbon compound.

12. A process according to claim 1, further comprising a stage (6) in which the product obtained from stage (5) is contacted with a basic compound and the product of this stage is then washed with water.

13. A process according to claim 1, wherein the polysulphurized olefin composition has a sulphur content up to 65% by weight and a residual chlorine content below 0.1% by weight.

14. A process for producing a polysulphurized composition comprising:

(a) contacting an adduct with an alcoholic solution, said adduct having been produced in a stage (1) in which at least one compound chosen from among sulphur dichloride and monochloride is reacted with at least one aliphatic monoolefin with 2 to 12 carbon atoms, thus forming said adduct, and said alcoholic solution having been produced in a stage (2) in which sulphurized hydrogen and at least one mercaptan is reacted with ammonium or alkali metal hydroxide dissolved in at least one aliphatic monoalcohol with 1 to 4 carbon atoms, which is substantially anhydrous, so as to give said alcoholic solution; and (b) heating the resultant contacted mixture and then distilling off the aliphatic monoalcohol while adding a sufficient quantity of water to maintain in solution the mineral products formed during the reaction.

* * * * *